US012768098B2

(12) United States Patent
Aoki et al.

(10) Patent No.: US 12,768,098 B2
(45) Date of Patent: Oct. 20, 2026

(54) METHOD FOR PRODUCING CARBAMATED CELLULOSE FIBERS

(71) Applicant: Daio Paper Corporation, Ehime (JP)

(72) Inventors: Ryunosuke Aoki, Ehime (JP); Ikko Matsusue, Ehime (JP); Naoto Umeguchi, Ehime (JP)

(73) Assignee: Daio Paper Corporation, Ehime (JP)

( * ) Notice: Subject to any disclaimer, the term of this patent is extended or adjusted under 35 U.S.C. 154(b) by 213 days.

(21) Appl. No.: 18/293,231

(22) PCT Filed: Aug. 4, 2022

(86) PCT No.: PCT/JP2022/029975
§ 371 (c)(1),
(2) Date: Jan. 29, 2024

(87) PCT Pub. No.: WO2023/047815
PCT Pub. Date: Mar. 30, 2023

(65) Prior Publication Data

US 2024/0376663 A1 Nov. 14, 2024

(30) Foreign Application Priority Data

Sep. 27, 2021 (JP) ..... 2021-156578

(51) Int. Cl.
*D06M 13/00* (2006.01)
*D06M 13/432* (2006.01)

(52) U.S. Cl.
CPC ..... *D06M 13/432* (2013.01)

(58) Field of Classification Search
CPC ..... D06M 13/432; C08B 15/06; D21C 9/005; D21C 9/007; D21H 11/18; D21H 11/20
(Continued)

(56) References Cited

U.S. PATENT DOCUMENTS 4,530,999 A 7/1985 Selin
4,567,255 A * 1/1986 Eklund ..... C08B 15/06 536/30
(Continued)

FOREIGN PATENT DOCUMENTS

CN 106661131 A * 5/2017 ..... C08B 15/06
FI 67562 C * 4/1985 ..... C08B 15/06
(Continued)

OTHER PUBLICATIONS

An English language translation of 2003, pp. 251,252 fig.5.69, p. 252, right column, line 5-19, (The Chemical Society of Japan. Maruzen Co., Ltd.), non-official translation (Chemistry handbook: Applied chemistry 6th edition).
(Continued)

*Primary Examiner* — Eisa B Elhilo
(74) *Attorney, Agent, or Firm* — Andrus Intellectual Property Law, LLP

(57) ABSTRACT

A method for preparing carbamated cellulose fibers applicable to mass production is provided. The method for preparing carbamated cellulose fibers in which hydroxyl groups of cellulose fibers have partially or fully been modified with carbamate groups, includes heating a pulp sheet which has been formed into a strip shape by subjecting a raw material pulp to papermaking and contains urea or a derivative thereof, between a pair of rolls while passing therebetween, to cause the modification.

6 Claims, 1 Drawing Sheet

(58) Field of Classification Search
USPC ..... 8/115.51
See application file for complete search history.

(56) References Cited

U.S. PATENT DOCUMENTS

| | | | |
|---|---|---|---|
| 2016/0193754 | A1 | 7/2016 | Gomi |
| 2020/0115471 | A1 | 4/2020 | Tsujii |
| 2022/0098798 | A1 | 3/2022 | Watanabe |
| 2023/0093348 | A1 | 3/2023 | Imai |
| 2023/0357449 | A1 | 11/2023 | Imai |

FOREIGN PATENT DOCUMENTS

| | | | | | |
|---|---|---|---|---|---|
| FI | 112795 | B | * | 1/2004 | ..... C08B 15/06 |
| JP | S60-123502 | A | | 7/1985 | |
| JP | S60-210601 | A | | 10/1985 | |
| JP | 2018171126 | A | * | 11/2018 | ..... A47L 13/17 |
| JP | 2019001876 | A | | 1/2019 | |
| JP | 2020105473 | A | | 7/2020 | |
| JP | 2021075665 | A | | 5/2021 | |
| JP | 2021143239 | A | | 9/2021 | |
| JP | 2021143240 | A | | 9/2021 | |
| WO | WO 03064476 | A1 | * | 8/2003 | ..... C08B 15/06 |
| WO | WO 2021182181 | A1 | * | 9/2021 | ..... C08L 101/00 |
| WO | 2022030391 | A1 | | 2/2022 | |

OTHER PUBLICATIONS

Extended European Search Report for EP Patent Application No. 22872571.9, dated Sep. 12, 2025.
PCT/JP2022/029975, International Search Report and Written Opinion, dated Sep. 21, 2022, 7 pages.
Loan. T.T. Vo et al., Direct carbamation of cellulose fiber sheets, Cellulose (2014) 21:627-640.
2003, pp. 251,252 fig.5.69, p. 252, right column, line 5-19, (The Chemical Society of Japan. Maruzen Co., Ltd.), non-official translation (Chemistry handbook: Applied chemistry 6th edition).

* cited by examiner

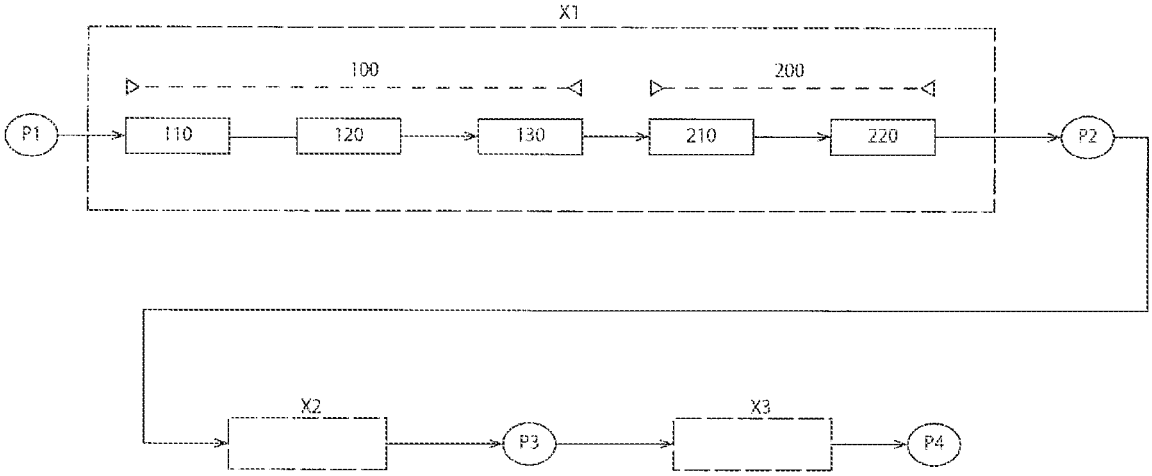
X1
100
200
P1
110
120
130
210
220
P2
X2
P3
X3
P4

METHOD FOR PRODUCING CARBAMATED CELLULOSE FIBERS

CROSS-REFERENCE TO RELATED APPLICATIONS

This application is the U.S. national stage application of International Application PCT/JP2022/029975, filed Aug. 4, 2022, which international application was published on Mar. 30, 2023, as International Publication WO 2023/047815 in the Japanese language. The International Application claims priority to Japanese Patent Application No. 2021-156578, filed Sep. 27, 2021. The international application and Japanese application are both incorporated herein by reference, in entirety.

FIELD OF THE INVENTION

The present invention relates to a method for preparing carbamated cellulose fibers.

BACKGROUND ART

Fine fibers, such as cellulose nanofibers and microfiber cellulose (microfibrillated cellulose), have hitherto been attracting attention, and there has recently been proposed, for example, to introduce anionic groups into cellulose fibers (to modify cellulose fibers with anionic groups) (see Patent Publication 1).

While use of fine fibers as reinforcing materials for resins has been attracting attention, there has also been proposed to substitute hydroxy groups of the fine fibers with carbamate groups, since the fine fibers are hydrophilic whereas the resins are hydrophobic (see Patent Publication 2). According to this proposal, dispersibility of the fine fibers is improved, and thus the reinforcing effect on resins is enhanced.

The proposals discussed above, however, are not suitable for mass production, since the cellulose fibers are required to be kept in the form of an aqueous dispersion for modification.

Patent Publication 1: JP 2021-075665 A
Patent Publication 2: JP 2019-001876 A

SUMMARY OF THE INVENTION

It is an object of the present invention to provide a method for preparing carbamated cellulose fibers applicable to mass production.

First, the present inventors thought of an idea that technology for producing pulp sheets in the art of papermaking might be utilized for mass production of carbamated cellulose fibers. In the art of papermaking, the pulp sheet per se is the objective product, but according to the present invention, the pulp sheet is merely transient, of which form or shape is temporarily used. Thus, the papermaking technology cannot be applied as it is to quick carbamation. In view of this, the present inventors have made unique trial and errors in the development of the present invention, and have reached the following means.

<Invention of Claim 1>

A method for preparing carbamated cellulose fibers in which hydroxyl groups of cellulose fibers have partially or fully been modified with carbamate groups, the method including:

heating a pulp sheet which has been formed into a strip shape by subjecting a raw material pulp to papermaking and contains urea or a derivative thereof, between a pair of rolls while passing therebetween, to cause the modification.

<Invention of Claim 2>

The Method According to Claim 1, wherein the pulp sheet has a width of 300 to 10000 mm, and at least either one of the pair of the rolls is a heating roll.

<Invention of Claim 3>

The method according to claim 2, wherein a heating temperature of the heating roll is 180 to 280° C.

<Invention of Claim 4>

The Method According to Claim 1, wherein at least either one of the pair of the rolls is a heating roll, and a plurality of pairs of the rolls are provided in multiple stages, and wherein a heating temperature on a first stage is 80 to 140° C., and heating temperatures on second and subsequent stages are within a range of 180 to 280° C.

<Invention of Claim 5>

The Method According to Claim 1, wherein at least either one of the pair of the rolls is a heating roll, and a plurality of pairs of the rolls are provided in multiple stages, and wherein a linear nip pressure between a pair of the rolls on at least one of the stages is 1 to 100000 N/cm.

<Invention of Claim 6>

The method according to claim 1, wherein a step of subjecting the raw material pulp to papermaking to form a strip-shaped pulp sheet, a step of coating the pulp sheet with urea or a derivative thereof, and a step of modification with the urea or a derivative thereof, are incorporated in this order in the method as continuous on-machine steps.

According to the present invention, there is provided a method for preparing carbamated cellulose fibers applicable to mass production.

BRIEF DESCRIPTION OF THE DRAWINGS

FIG. 1 is an explanatory chart illustrating the steps for obtaining carbamated fine fibers from raw material pulp.

DESCRIPTION OF THE INVENTION

Next, embodiments for carrying out the present invention are discussed. It should be noted that the present embodiments are mere examples of the present invention, and the scope of the present invention is not limited by the scope of the present embodiments.

As shown in FIG. 1, the preparation method according to the present embodiment may be divided mainly into step X1 up to obtaining, from raw material pulp P1, a cellulose fiber-containing material P2 which may be used as "a pulp sheet containing urea or a derivative thereof (sometimes simply referred to as "urea or the like"; step X2 following step X1, up to obtaining carbamated cellulose fibers P3 by reacting the urea or the like on the cellulose fibers; and step X3 following step X2, up to obtaining carbamated fine fibers P4 by defibrating the carbamated cellulose fibers P3.

Further, step X1 up to obtaining a cellulose fiber-containing material P2 may be divided mainly into a step 100 of papermaking from the raw material pulp P1 to obtain a strip-shaped pulp sheet, and a step 200 of coating the pulp sheet with the urea or the like. Discussions will be made in order.

<Raw Material Pulp>

As the raw material pulp P1, one or more members may be selected and used from the group consisting of, for example, wood pulp made from hardwood, softwood, or the like; non-wood pulp made from straw, bagasse, cotton, hemp, bast fibers, or the like; and de-inked pulp (DIP) made from recovered used paper, waste paper, or the like.

In this regard, however, the raw material pulp P1 is preferably wood pulp in order to avoid contamination of impurities as much as possible. As the wood pulp, one or more members may be selected and used from the group consisting of, for example, chemical pulp, such as hardwood kraft pulp (LKP), softwood kraft pulp (NKP), or the like, mechanical pulp (TMP), and the like.

The hardwood kraft pulp may be hardwood bleached kraft pulp, hardwood unbleached kraft pulp, or hardwood semi-bleached kraft pulp. Similarly, the softwood kraft pulp may be softwood bleached kraft pulp, softwood unbleached kraft pulp, or softwood semi-bleached kraft pulp.

In this regard, it is preferred to combine NKP (preferably NBKP) and LKP (preferably LBKP). Here, NKP has thicker and longer cellulose fibers, which enhances the strength of the cellulose fiber-containing material, but impairs the formation. On the other hand, LKP has thinner and shorter cellulose fibers, which results in lower strength of the pulp sheet resulting from papermaking, but improves the formation. In view of such properties, when NKP and LKP are combined, the proportion of NKP is preferably 1 to 99 mass %, more preferably 5 to 95 mass %, particularly preferably 10 to 90 mass %. At a proportion of NKP below 1 mass %, paper breakage possibly due to insufficient tensile strength or tear resistance may occur during the papermaking step or the coating step. At a proportion of NKP over 99 mass %, i.e., at a proportion of LKP below 1 mass %, for example, properties, such as a resin reinforcing effect, may not be achieved sufficiently.

As the mechanical pulp, one or more members may be selected and used from the group consisting of, for example, stone ground pulp (SGP), pressurized stone ground pulp (PGW), refiner ground pulp (RGP), chemi-ground pulp (CGP), thermo-ground pulp (TGP), ground pulp (GP), thermomechanical pulp (TMP), chemithermomechanical pulp (CTMP), refiner mechanical pulp (RMP), and bleached thermomechanical pulp (BTMP).

The freeness of the raw material pulp P1 as measured in accordance with JIS P 8121-2 is preferably 200 to 700 cc, more preferably 250 to 650 cc, particularly preferably 300 to 600 cc. With a freeness below 200 cc, dewaterability in the wire section to be discussed later is impaired, and the papermaking speed may not be increased. With a freeness over 700 cc, the formation is impaired and paper breakage may occur in the subsequent coating step.

It is preferred to add a sizing agent internally and/or externally to the raw material pulp P1 to adjust the Stoeckigt sizing degree (JIS P 8122) and/or the Cobb sizing degree (JIS P 8140). Here, the Stoeckigt sizing degree is determined by a test to measure the time required for a liquid chemical to permeate a pulp sheet and develop color, and a lower value represents higher permeability. The Cobb sizing degree is determined by a test to measure the water absorption (mass) of a pulp sheet when one side thereof is brought into contact with water for a predetermined period of time, and a higher value representing a higher water absorption. Thus, the Stoeckigt sizing degree, which is an index of permeability, and the Cobb sizing degree, which is an index of water absorption, widely differ between with and without a sizing agent. In this regard, with a larger amount of a sizing agent, the amount of the urea or the like to be added (amount to be permeated) in the coating step to be discussed later is insufficient, which may lead to insufficient reaction. With a smaller amount of a sizing agent, paper breakage may occur due to a lower wet paper strength. Thus, it is necessary to adjust the amount of the sizing agent to be added, which amount may be decided based on the Stoeckigt sizing degree or the Cobb sizing degree of the pulp sheet as measured before coated with the urea or the like.

Specifically, the Stoeckigt sizing degree as measured in accordance with JIS P 8122 is preferably 0.1 to 100 seconds, more preferably 0.2 to 80 seconds, particularly preferably 0.5 to 50 seconds. The Cobb sizing degree as measured in accordance with JIS P 8140 (10 seconds) is preferably 10 to 600 g/m$^2$, more preferably 20 to 580 g/m$^2$, particularly preferably 30 to 550 g/m$^2$.

The ash content of the raw material pulp P1 as measured in accordance with JIS P 8251 is preferably 0 to 20 mass %, more preferably 0 to 15 mass %, particularly preferably 0 to 20 mass %. With an ash content over 20 mass %, the strength of the pulp sheet in a wet condition is low, which may lead to paper breakage particularly in the coating step.

It should be noted that the preparation method according to the present invention is not a production method of paper, but merely utilizes the state or form of the pulp sheet for effectively reacting the urea or the like. Thus, knowledge about addition of ash in papermaking technology is not directly applicable and, for example, the content of this ash may affect the progress of defibration, if performed in a subsequent step.

<Papermaking Step>

In the method according to the present embodiment, the raw material pulp P1 is subjected to papermaking to obtain a strip-shaped pulp sheet in papermaking step 100. Here, the term "strip-shaped" means that the pulp sheet is in the form of an elongate continuous sheet with a predetermined width (e.g., 300 to 10000 mm), and has a shape the same as or similar to that of wet paper or paper web in paper manufacturing process.

The papermaking equipment used in the papermaking step 100 may be, for example, a Fourdrinier former having a wire section 110, a press section 120, and the like, a Fourdrinier former combined with an on-top former, or a gap former.

Use of a gap former is advantageous, in which a jet of stock injected from a head box is immediately held between twin wires, since little difference results between the front and back surfaces of the resulting pulp sheet, so that the urea or the like may permeate the pulp sheet evenly in the thickness direction (z-axis direction).

Though this gap former has the advantage of resulting little difference between the front and back surfaces of the pulp sheet, the pulp sheet is poor in flatness as it contacts the wire surfaces on both sides, and is also poor in formation as the formation is fixed instantaneously upon injection of the stock onto the wires. Production of paper per se is not an object of the present embodiment, so that the flatness or the formation may not matter, but in view of the subsequent coating manner or permeability of liquid chemical, it is preferred to employ on-top linear fords for good flatness and formation. In particular, with a shaking mechanism (mechanism for shaking the wires transversely) attached to the wires, the formation may still be improved advantageously.

The pulp sheet (paper layer) from the wire section 110 flows to (is transferred to) the press section 120, where it is subjected to dehydration.

A press used in the press section 120 may be of, for example, a straight-through type, an inverted type, a reverse type, or a combination thereof. The straight-through type press without open draw is preferred as the pulp sheet is easily supported, and operation troubles, such as paper breakage, seldom occur.

The pulp sheet (wet paper) from the press section 120 may be transferred to a pre-dryer section 130 of, for example, a single deck type or a double deck type, for drying. The pre-dryer section 130 is preferably a single deck dryer of a no-open-draw type, in which highly efficient drying may be performed without paper breakage or bulk reduction.

The drying temperature in the pre-dryer section 130 is preferably 80 to 140° C., more preferably 85 to 135° C., particularly preferably 90 to 130° C. At a drying temperature over 140° C., localized overdrying may occur, wherein permeation of the urea or the like in the coating step 200 may be impaired. At a drying temperature below 80° C., localized underdrying may occur, wherein paper breakage may occur.

The pulp sheet from the pre-dryer section 130 has a moisture percentage of preferably 0.1 to 10%, more preferably 1 to 9%, particularly preferably 2 to 8%. At a moisture percentage below 0.1%, the pulp sheet is overdried, and permeation of the urea or the like in the coating step 200 may be impaired. At a moisture percentage over 10%, the pulp sheet is underdried, and paper breakage may occur in the coating step 200.

As used herein, the moisture percentage refers to a value measured with a BM (basis weight/moisture) meter using infrared.

The strip-shaped pulp sheet obtained from the papermaking step 100 has a basis weight of preferably 60 to 800 g/m$^2$, more preferably 80 to 750 g/m$^2$, particularly preferably 100 to 700 g/m$^2$, as measured in accordance with JIS P 8124. With a basis weight below 50 g/m$^2$, paper breakage due to insufficient strength may occur particularly in the coating step 200. With a basis weight over 800 g/m$^2$, the urea or the like may not permeate sufficiently in the coating step 200. Note that the basis weight discussed above is for a single ply. With a plurality of plies having two or more plies, the liquid chemicals may stay at the interface between the plies.

The urea or the like applied in the coating step 200 may contain any papermaking chemicals. The kinds of the papermaking chemicals are not particularly limited, and the concentration of the papermaking chemicals may suitably be adjusted as required. However, it is naturally required not to obstruct the purpose of applying the urea or the like, and adjustment may be required in some cases. For example, according to the present embodiment where the urea or the like is used, papermaking is performed so that papermaking chemicals, such as those having hydroxyl groups, for example, various starches or CMC (carboxymethylcellulose), those having a group, such as a silanol group, in which-OH is bound to a certain element, for example, colloidal silica or aluminum sulfate, rosin sizing agents, ASA (alkenyl succinic anhydride), AKD (alkylketene dimers), various starches, CMC, or the like, are at a concentration of preferably 0 to 10%, more preferably 0.1 to 9%, particularly preferably 0.2 to 8% in the papermaking step 100. As above-mentioned papermaking chemicals undergo modification with the urea or the like, use of the urea or the like in the reaction step X2 will be hindered, with a large amount of such papermaking chemicals contained in the urea or the like. It does not matter whether the above-mentioned papermaking chemicals are added internally or externally.

Dyes may be contained in the pulp sheet, depending on the intended use of the resulting product. For example, when the resulting product is to be used as a reinforcing material for resin and thus coloring with the fine fibers is not desired, the papermaking is performed so that the content of the dyes is preferably 0 to 10%, more preferably 0.1 to 5%, particularly preferably 0.2 to 3%.

Similarly, the brightness of the pulp sheet as measured in accordance with JIS P 8148 is preferably 80% or higher, more preferably 82% or higher, particularly preferably 85% or higher. Note that, when the raw material pulp P1 is LBKP and NBKP as in the embodiment discussed above, the brightness usually becomes 80% or higher, and thus no adjustment is required.

The tensile strength of the pulp sheet as measured in accordance with JIS P 8113 is preferably 10 MPa or higher, more preferably 15 MPa or higher, particularly preferably 20 MPa or higher. With a tensile strength below 10 MPa (1 KN/m, 100 μm thick), paper breakage may occur in the coating step 200. Though a higher basis weight may result in a higher tensile strength, increase in the basis weight, as discussed above, may cause difficulties in permeation of the urea or the like in the coating step 200. Accordingly, the balance between the tensile strength and the basis weight is important, and the specific tensile strength (tensile strength/basis weight) is preferably 1 to 10000 Nm/g, more preferably 5 to 5000 Nm/g, particularly preferably 10 to 1000 Nm/g.

The wet paper strength of the pulp sheet as measured in accordance with JIS P 8135 is preferably 0.1 kN/m or higher, more preferably 0.2 kN/m or higher, particularly preferably 0.5 kN/m or higher. With a wet paper strength below 0.1 kN/m, paper breakage may occur in the coating step 200. Though a higher basis weight may result in a higher wet paper strength, increase in the basis weight, as discussed above, may cause difficulties in permeation of the urea or the like in the coating step 200. Accordingly, the balance between the wet paper strength and the basis weight is important, and the specific wet paper strength (wet paper strength/basis weight) is preferably 0.1 to 5000 Nm/g, more preferably 0.5 to 1000 Nm/g, particularly preferably 1 to 500 Nm/g.

<Coating Step>

The pulp sheet dried in the pre-dryer section 130 is coated with the urea or the like in coater section 210 between the pre-dryer section 130 and the after-dryer section 220. As used herein, the term "coating" merely means the action of "application", and does not intend to limit the state of the applied urea or the like. Accordingly, for example, the term "coating" encompasses not only an embodiment wherein the urea or the like remain on the pulp sheet surface to form a coating layer, but also an embodiment wherein the urea or the like fully permeate the pulp sheet to form no coating layer on the pulp sheet surface, i.e., a simple, impregnated state.

In the coater section 210, coating with the urea or the like may be performed through a coating method, such as beveled blade coating, size press coating, bent blade coating, rod coating, immersion coating, spray coating, or comma coating. Preferably, the coating in the coater section 210 is performed through bent blade coating. Bent blade coating is a kind of blade coating and, while in another kind of blade coating, beveled blade coating, the urea or the like sprayed with a fountain is scraped off, the urea or the like is pressed into the pulp sheet in bent blade coating. Thus, bent blade coating is suitable for the present embodiment intensely requiring permeation of the urea or the like into the pulp sheet.

On the other hand, immersion coating and comma coating have the following features.

As used herein, the term "immersion coating" means a method of coating by causing a pulp sheet to travel in a vessel containing the urea or the like. The term "comma coating" means a method of coating by causing a pulp sheet to travel through a clearance between two rolls, which form a liquid pool with a blade, with the clearance adjusting the coating amount.

The concentration of the urea or the like may suitably be adjusted as necessary. According to the present embodiment for carbamation, the concentration of the urea or the like is preferably 20 to 50 mass %, more preferably 25 to 45 mass %, particularly preferably 30 to 40 mass %. At a concentration of the urea or the like below 20 mass %, the rate of carbamation is insufficient and drying may be difficult. At a concentration of the urea or the like over 50 mass %, melting of the urea or the like in preparing aqueous urea solution may cause endothermic reaction to lower the temperature of the solution, resulting in precipitation of urea or the like.

The viscosity of the aqueous urea solution (40% concentration) as measured in accordance with JIS Z8803 (2011) is preferably 2000 cps or lower, more preferably 1700 cps or lower, particular preferably 1500 cps or lower. At a viscosity over 2000 cps, the aqueous urea solution is hard to permeate the pulp sheet.

According to the preparation method of the present embodiment, the coating step 200 may be performed off-line or on-line. However, when the production speed is 300 m/min or higher, it is preferred that the papermaking step 100 and the coating step 200 are incorporated in the method (on-line) in this order as continuous on-machine steps. With the coating step 200 being on-line, production efficiency is improved, and uniform coating may be achieved without being affected by the storage conditions of the pulp sheet or the like.

According to the preparation method of the present embodiment, the urea or the like may be applied to only either side or both sides of the pulp sheet. In view of uniformity of the reaction in the subsequent step, the urea or the like is preferably applied to both sides of the pulp sheet.

Off-line application of the urea or the like on both sides of the pulp sheet may be advantageous in that each side of the pulp sheet may be coated with a different amount of the urea or the like depending on the characteristics of the pulp sheet.

The ratio by mass of the urea or the like coating the cellulose fibers (the urea or the like/cellulose fibers) is preferably 10 to 400 kg/pt (pulp ton), more preferably 20 to 300 kg/pt, particularly preferably 45 to 200 kg/pt. At a ratio by mass below 45 kg/pt, carbamation may not proceed sufficiently. At a ratio by mass over 200 kg/pt, coating is excessive and excess urea or the like may adhere to the machines. While the amount of the coating is usually defined in terms of mass per 1 $m^2$, according to the present embodiment, the urea or the like is a chemical (reaction agent) for reacting on the cellulose fibers, so that the amount of the coating is defined preferably in terms of the amount of urea per unit mass of the cellulose fibers.

The pulp sheet from the coater section 210 is transferred to the after-dryer section 220 for drying.

For drying in the after-dryer section 220, dryers, such as hot-air dryers, gas-heating dryers, or infrared dryers may be used. However, with infrared dryers, the urea or the like may be hardened on the pulp sheet surface to keep it from permeation. Thus, hot-air dryers are preferred. In particular, hot-air dryers, whose temperature control is easy, may be arranged in a plurality of stages and designed for gradual rise in temperature, which may proceed with drying without disturbing the permeation of the urea or the like.

In the after-dryer section 220, the drying temperature is preferably 80 to 140° C., more preferably 85 to 135° C., particularly preferably 90 to 130° C. At a drying temperature below 80° C., shorter drying time may result in insufficient drying, so that such drying temperature is not suitable for high-speed production. At a drying temperature over 140° C., the urea or the like may produce byproducts.

The moisture percentage of the pulp sheet from the after-dryer section 220 is preferably 0 to 10%, more preferably 0 to 8%, particularly preferably 0 to 7%. With a moisture percentage of the pulp sheet over 10%, reaction efficiency may be deteriorated in the reaction step.

In this step, the moisture percentage mentioned above is a value as measured with a BM (basis weight/moisture) meter using infrared.

The surface temperature of the pulp sheet from the after-dryer section 220 is preferably 30 to 95° C., more preferably 35 to 90° C., particularly preferably 40 to 85° C. With a surface temperature below 40° C., sufficient drying may not be achieved. With a surface temperature over 95° C., the reaction agent may produce byproducts.

It should be noted that production of paper per se is not an object of the present embodiment, and merely the form as paper (pulp sheet) is temporarily used. Accordingly, the after-dryer section may be followed by a calender step, or by the reaction step with a calender step omitted.

<Carbamation Step>

The pulp sheet (pulp fiber-containing material) from the after-dryer section 220 may once be, for example, taken up in a winder section (not shown) and stored as a wound raw material roll. Then, the wound raw material roll may be subjected as it is to a process, such as heating or cooling, and cause reaction of the urea or the like on the cellulose fibers or, preferably, the pulp sheet is drawn out of the wound raw material roll and processed to proceed with the carbamation.

When the pulp sheet is once taken up as a wound raw material roll, it is preferred to dry the pulp sheet thus drawn out to have a moisture percentage of 10 mass % or lower, more preferably 9 mass % or lower, particularly preferably 8 mass % or lower. This drying is carried out for the purpose of increasing the reaction efficiency.

In fact, when the pulp sheet is once taken up to form a wound raw material roll as discussed above, the production efficiency is lowered. In this regard, it is more preferred for the pulp sheet from the after-dryer section 220 to proceed (to be transferred) continuously to carbamation step X2. In this case, the above-mentioned drying of the pulp sheet prior to the carbamation may be omitted.

In the carbamation step X2, the urea or the like contained in the pulp sheet, i.e., the cellulose fiber-containing material, is reacted on the cellulose fibers. Here, this reaction will now be explained in detail.

First of all, the term "carbamation" means to modify the cellulose fibers with carbamate groups, that is, to make the cellulose fibers have carbamate (esters of carbamic acid) introduced therein.

Carbamate groups are represented by —O—CO—NH—, and may be, for example, —O—CO—$NH_2$, —O—CONHR, or —O—CO—$NR_2$. In other words, carbamate groups are represented by the following structural formula (1):

[Formula 1]

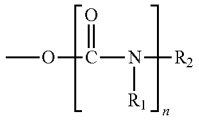

In the formula, n is an integer of 1 or more. R is independently at least any of hydrogen, a saturated straight chain hydrocarbon group, a saturated branched hydrocarbon group, a saturated cyclic hydrocarbon group, an unsaturated straight chain hydrocarbon group, an unsaturated branched hydrocarbon group, an aromatic group, and derivative groups thereof. Further, cross-linked carbamated cellulose in which cross-linked structures via carbamate groups have been formed between the cellulose molecules or fibers, may also be used.

The saturated straight chain hydrocarbon group may be, for example, a straight chain alkyl group having 1 to 10 carbon atoms, such as a methyl group, an ethyl group, or a propyl group.

The saturated branched hydrocarbon group may be, for example, a branched alkyl group having 3 to 10 carbon atoms, such as an isopropyl group, a sec-butyl group, an isobutyl group, or a tert-butyl group.

The saturated cyclic hydrocarbon group may be, for example, a cycloalkyl group, such as a cyclopentyl group, a cyclohexyl group, or a norbornyl group.

The unsaturated straight chain hydrocarbon group may be, for example, a straight chain alkenyl group having 2 to 10 carbon atoms, such as an ethenyl group, a propene-1-yl group, or a propene-3-yl group, or a straight chain alkynyl group having 2 to 10 carbon atoms, such as an ethynyl group, a propyn-1-yl group, or a propyn-3-yl group.

The unsaturated branched hydrocarbon group may be, for example, a branched alkenyl group having 3 to 10 carbon atoms, such as a propene-2-yl group, a butene-2-yl group, or a butene-3-yl group, or a branched alkynyl group having 4 to 10 carbon atoms, such as a butyne-3-yl group.

The aromatic group may be, for example, a phenyl group, a tolyl group, a xylyl group, or a naphthyl group.

The derivative groups may be a saturated straight chain hydrocarbon group, a saturated branched hydrocarbon group, a saturated cyclic hydrocarbon group, an unsaturated straight chain hydrocarbon group, an unsaturated branched hydrocarbon group, or an aromatic group, in which one or a plurality of hydrogen atoms thereof is substituted with a substituent (for example, a hydroxy group, a carboxy group, or a halogen atom).

In the cellulose fibers having carbamate groups (having carbamate groups introduced), part or all of the highly polar hydroxy groups have been substituted with relatively low polar carbamate groups. Thus, such cellulose fibers have lower hydrophilicity and higher affinity to resins having lower polarity. As a result, fine fibers obtained by defibrating such cellulose fibers have excellent homogeneous dispersibility in resins. Further, a slurry of such fine fibers is low in viscosity and excellent in handleability.

The lower limit of the substitution degree of the hydroxy groups of the cellulose fibers with carbamate groups is preferably 0.05, more preferably 0.1, particularly preferably 0.2. With a substitution degree of 0.05 or higher, the effect from the introduction of carbamate may certainly be produced. On the other hand, the upper limit of the substitution degree is preferably 1, more preferably 0.5, particularly preferably 0.4. In this regard, cellulose fibers with higher substitution degree is disadvantageously expensive.

Note that cellulose is a polymer having anhydroglucose as a structural unit, wherein one structural unit includes three hydroxy groups. Accordingly, when all of the hydroxy groups are substituted with carbamate groups, the substitution degree is 3.

The amount of carbamate groups introduced into the cellulose fibers is preferably 0.5 to 4.5 mmol/g, more preferably 0.6 to 4.0 mmol/g, particularly preferably 0.7 to 3.5 mmol/g. At a substitution degree below 0.5 mmol/g, sufficient reinforcing effect may not be achieved when made into a composite resin. At a substitution degree over 4.5 mmol/g, excess urine may be required.

With respect to introduction of carbamate (carbamation) into the cellulose fibers, the cellulose fibers may be carbamated followed by making the carbamated fibers finer, or the cellulose fibers may be made finer into fine fibers followed by carbamation thereof. It is preferred to perform the carbamation first, followed by the defibration, as in the present embodiment. This is because dewaterability of the cellulose fibers before the defibration is highly effective, and the defibration of the cellulose fibers may be facilitated by the heating associated with the carbamation.

Hitherto, the process of carbamating the cellulose fibers generally involved, for example, a mixing step, a removing step, and a heating step. In the mixing step, the cellulose fibers and the urea or the like are mixed in a dispersion medium. However, with this mixing step, the production efficiency is remarkably deteriorated. In view of this, according to the present embodiment, the urea or the like is reacted on the cellulose fibers in the form of a strip-shaped pulp sheet. Here, the pulp sheet may be in the form of a wound raw material roll or in a state drawn out of the wound raw material roll. The reaction efficiency and the reaction uniformity are better in the drawn-out state.

The urea or the derivatives thereof may be, for example, urea, thiourea, biuret, phenylurea, benzylurea, dimethylurea, diethylurea, tetramethylurea, or compounds obtained by substituting the hydrogen atoms of urea with alkyl groups. One or a combination of a plurality of these urea or derivatives thereof may be used, and use of urea is preferred.

In the carbamation step X2 according to the present embodiment, the pulp sheet, i.e., the cellulose fiber-containing material P2 containing the urea or the like, is heat treated. In the carbamation step X2, the hydroxy groups of the cellulose fibers are partially or fully reacted with the urea or the like and substituted with carbamate groups. More specifically, the urea or the like, when heated, is decomposed into isocyanic acid and ammonia as shown by the reaction formula (1) below, and the isocyanic acid, which is highly reactive, reacts with the hydroxyl groups of cellulose to form carbamate groups as shown by the reaction formula (2) below.

$$NH_2—CO—NH_2 \rightarrow H—N=C=O + NH_3 \quad (1)$$

$$Cell\text{-}OH + H—N=C=O \rightarrow Cell\text{-}O—CO—NH_2 \quad (2)$$

For reacting the urea or the like on the cellulose fibers, the heating temperature in the carbamation step X2 is preferably 150 to 280° C., more preferably 160 to 270° C., particularly preferably 180 to 260° C. At a heating temperature below 150° C., sufficient reaction may not be achieved. At a heating temperature over 280° C., the urea or the like may be thermally decomposed, or the coloring may be remarkable.

For reacting the urea or the like on the cellulose fibers, the duration of the heating in the carbamation step X2 is preferably 1 to 60 seconds, more preferably 1 to 30 seconds, particularly preferably 1 to 20 seconds. With a duration of the heating over 60 seconds, the coloration may be remarkable, and the productivity is poor.

As discussed above, the pulp sheet may be heated in an as-taken-up state, or in a state drawn out of the wound raw material roll. For heating the pulp sheet in an as-taken-up state, apparatus such as of hot-air heating type, high-frequency heating type, or a rotary kiln type may be used. On the other hand, for heating the pulp sheet drawn out of the wound raw material roll, apparatus such as induction heating rolls, oil-heated rolls, hot-air heaters, far-infrared heaters, or microwave heaters may be used.

Here, discussion will now be made as to operation features when the above-mentioned heaters are used.

First, the heating method may generally be divided into two types (batch type and continuous (roll-to-roll) type). The batch-type heating may be carried out with high-frequency heaters and rotary kilns, which may cause reaction of a large amount of samples at a time. In this regard, in a high-frequency heater, when an item to be heated is placed between the electrodes, polarization occurs inside the item to create electrical charges, which changes frequency rate to cause vigorous internal friction of molecules to cause heating. On the other hand, the rotary kiln is rotary high-temperature firing apparatus, and used for recovering chemicals from a kraft pulping step in the art of papermaking.

On the other hand, the roll-to-roll heating wherein the pulp sheet is heated while passing between a pair of rolls may be carried out with induction heating rolls or oil-heated rolls for continuous heating of a pulp sheet coated with urea, or hot-air heaters, far-infrared heaters, or microwave heaters, for further continuous heating. In this regard, the induction heating rolls perform the heating by inducing heat of the rolls per se under the action of an electrically generated magnetic field, and are also used in calender equipment in a papermaking process. Oil-heated rolls circulate heated oil inside the rolls to heat the roll surfaces. Hot-air heaters inject hot air through nozzles arranged above and under a conveyer onto the top and bottom surfaces, respectively, of a pulp sheet to heat the same passing therebetween. Far-infrared heaters emit infrared rays with a wavelength of 3 μm to 1 mm to cause interatomic stretching and vending for heating. Microwave heaters generate heat depending on their frequency (300 MHZ to 30 GHz) by causing frictional heat between molecules constituting a pulp sheet, and a microwave oven is a general example thereof.

A reaction facility equipped with induction heating rolls, rather than oil-heated rolls, is preferred for their higher reaction efficiency and energy efficiency. On the other hand, by batch heating utilizing the wound raw material roll state, in particular with high-frequency wave, a large amount of samples are heated at a time, so that the reaction proceeds unevenly and uniform carbamation reaction may be difficult to achieve.

On the other hand, in continuous heating with apparatus other than the roll-to-roll heaters including the induction heating rolls or oil-heated rolls, for example, in non-contact heating, such as hot-air heating or far-infrared heating, carbamation may be promoted by increasing the reaction temperature.

In sum, it is particularly preferred to heat a pulp sheet which has been formed into a strip shape by subjecting the raw material pulp P1 to papermaking and contains the urea or the like, between a pair of rolls while passing therebetween, to cause the reaction. With a width of the pulp sheet of 300 to 10000 mm, either one of the pair of the rolls is more preferably a heating roll. Here, the heating temperature of the heating rolls is preferably 180 to 280° C., more preferably 200 to 270° C., particularly preferably 220 to 260° C.

It is further preferred that multiple stages of the rolls (a plurality of pairs of rolls) are arranged, and the heating temperature on the first stage is kept as low as 80 to 140° C. (more preferably 90 to 120° C.), and the heating temperatures on the second and subsequent stages are within a range of 180 to 280° C. In addition, the heating temperatures on the plurality of stages of the heating rolls may be gradually increased stage by stage within the range of 80 to 280° C. In this case, instead of keeping the first stage at a lower temperature, it is also preferred to set the linear nip pressure between a pair of the rolls on at least one of the stages to 1 to 100000 N/cm, preferably 10 to 50000 N/cm. The features discussed above advantageously keep the pulp sheet from shrinking.

<Defibration>

According to the present embodiment, the carbamated cellulose fibers P3 thus obtained is subjected to grinding or the like process, as required, and defibration (making finer) in defibration step X3. Through this defibration, carbamated fine fibers P4 are obtained.

As used herein, the term "fine fibers" mean cellulose fibers having an average fiber width of 0.01 to 19 μm. The fine fibers includes, for example, microfiber cellulose (microfibrillated cellulose) and cellulose nanofibers.

The reacted cellulose fibers P3 may be defibrated immediately after grinding or the like, but may be washed, prior to the defibration, by disintegrating in water the reacted cellulose fibers P3 in the form of a sheet or a ground product, and then dehydrating the resulting mass in dehydrating equipment, such as a valveless filter. When a valveless filter is used for the dehydration, the resulting, dehydrated, reacted cellulose fibers P3 in the form of a mat may be showered to perfect the washing. Through the washing, unreacted reaction liquid, byproducts of the reaction liquid, and water-soluble impurities may be removed.

As used herein, the term "microfiber cellulose" means fibers of a larger average fiber diameter compared to cellulose nanofibers, specifically, e.g., 0.1 to 19 μm, preferably 0.2 to 10 μm. With an average fiber diameter of microfiber cellulose below (less than) 0.1 μm, the microfiber cellulose differs nothing from cellulose nanofibers, and sufficient effect to enhance resin strength (particularly flexural modulus) may not be achieved when kneaded with a resin. Also, a longer time is required for defibration, which in turn requires more energy. Further, dewaterability of a cellulose fiber slurry is impaired. With such an impaired dewaterability, a high amount of energy is required for drying, which in turn may cause thermal deterioration of the microfiber cellulose to impair its strength. On the other hand, with an average fiber diameter over (exceeding) 19 μm, the microfiber cellulose differs nothing from pulp, and sufficient reinforcing effect may not be achieved.

The average fiber diameter of the fine fibers (microfiber cellulose and cellulose nanofibers) may be determined as follows.

First, 100 ml of an aqueous dispersion of fine fibers having a solid concentration of 0.01 to 0.1 mass % is filtered through a TEFLON (registered trademark) membrane filter, and subjected to solvent substitution once with 100 ml of ethanol and three times with 20 ml of t-butanol. Then the resulting mass is lyophilized and coated with osmium to obtain a sample. An electron microscopic SEM image of this sample is observed at a magnification of 3000 to 30000 folds, depending on the width of the constituent fibers. Specifically, two diagonal lines are drawn on the observation image, and three arbitrary straight lines passing the intersection of the diagonals are drawn. Then, the widths of a total of 100 fibers crossing these three straight lines are visually measured. The median diameter of the measured values is taken as the average fiber width.

The carbamated cellulose fibers P3 or a ground product thereof, may be pretreated, bleached, or otherwise treated, by a chemical method prior to the defibration.

Such pretreatment by a chemical method may be, for example, hydrolysis of polysaccharides with acid (acid treatment), hydrolysis of polysaccharides with enzyme (enzyme treatment), swelling of polysaccharides with alkali (alkali treatment), oxidation of polysaccharides with an oxidizing agent (oxidation treatment), or reduction of polysaccharides with a reducing agent (reduction treatment). Among these, as a pretreatment by a chemical method, enzyme treatment is preferred, and more preferred is one or more treatments selected from acid treatment, alkali treatment, and oxidation treatment, in addition to the enzyme treatment. The enzyme treatment is discussed in detail below.

As an enzyme used in the enzyme treatment, preferably at least one of, more preferably both of cellulase enzymes and hemicellulase enzymes are used. With such enzymes, defibration of the cellulose raw material is more facilitated. It is noted that cellulase enzymes cause degradation of cellulose in the presence of water, whereas hemicellulase enzymes cause degradation of hemicellulose in the presence of water.

The cellulase enzymes may be enzymes produced by, for example, the genus *Trichoderma* (filamentous fungus), the genus *Acremonium* (filamentous fungus), the genus *Aspergillus* (filamentous fungus), the genus *Phanerochaete* (basidiomycete), the genus *Trametes* (basidiomycete), the genus *Humicola* (filamentous fungus), the genus *Bacillus* (bacteria), the genus *Schizophyllum* (bacteria), the genus *Streptomyces* (bacteria), and the genus *Pseudomonas* (bacteria). These cellulase enzymes are available as reagents or commercial products. Examples of the commercial products may include, for example, Cellulosin T2 (manufactured by HBI ENZYMES INC.), Meicelase (manufactured by MEIJI SEIKA PHARMA CO., LTD.), Novozyme 188 (manufactured by NOVOZYMES), Multifect CX10L (manufactured by GENENCOR), and cellulase enzyme GC220 (manufactured by GENENCOR).

The cellulase enzymes may also be either EG (endoglucanase) or CBH (cellobiohydrolase). EG and CBH may be used alone or in mixture, or further in mixture with hemicellulase enzymes.

The hemicellulase enzymes may be, for example, xylanase, which degrades xylan; mannase, which degrades mannan; or arabanase, which degrades araban. Pectinase, which degrades pectin, may also be used.

Hemicellulose is a polysaccharide other than pectin, which is present among cellulose microfibrils of plant cell walls. Hemicellulose has numeral varieties and varies depending on the kinds of wood and among cell wall layers. Glucomannan is a major component in the secondary walls of softwood, whereas 4-O-methylglucuronoxylan is a major component in the secondary walls of hardwood. Thus, use of mannase is preferred for obtaining fine fibers from softwood bleached kraft pulp (NBKP), whereas use of xylanase is preferred for obtaining fine fibers from hardwood bleached kraft pulp (LBKP).

The amount of the enzyme to be added to the cellulose fibers may depend on, for example, the kind of enzyme, the kind of wood (either softwood or hardwood) used as a raw material, or the kind of mechanical pulp. The amount of the enzyme to be added may preferably be 0.1 to 3 mass %, more preferably 0.3 to 2.5 mass %, particularly preferably 0.5 to 2 mass %, of the amount of the cellulose fibers. With the amount of the enzyme below 0.1 mass %, sufficient effect due to the addition of the enzyme may not be obtained. With the amount of the enzyme over 3 mass %, cellulose may be saccharified to lower the yield of the fine fibers. A problem also resides in that improvement in effect worth the increased amount to be added may not be observed.

When a cellulase enzyme is used as the enzyme, the enzyme treatment is preferably carried out at a pH in a weakly acidic region (pH=3.0 to 6.9) in view of the enzymatic reactivity. On the other hand, when a hemicellulase enzyme is used as the enzyme, the enzyme treatment is preferably carried out at a pH in a weakly alkaline region (pH=7.1 to 10.0).

Irrespective of whether a cellulase enzyme or a hemicellulase enzyme is used as the enzyme, the enzyme treatment is carried out at a temperature of preferably 30 to 70° C., more preferably 35 to 65° C., particularly preferably 40 to 60° C. At a temperature of 30° C. or higher, the enzymatic activity is hard to be lowered, and prolongation of the treatment time may be avoided. At a temperature of 70° C. or lower, enzyme inactivation may be avoided.

The duration of the enzyme treatment may depend on, for example, the type of the enzyme, the temperature in the enzyme treatment, and the pH in the enzyme treatment. Generally, the duration of the enzyme treatment is 0.5 to 24 hours.

After the enzyme treatment, the enzyme is preferably inactivated. Inactivation of enzymes may be effected by, for example, addition of an alkaline aqueous solution (preferably at pH 10 or higher, more preferably at pH 11 or higher) or addition of 80 to 100° C. hot water.

Next, the alkali treatment is discussed.

Alkali treatment prior to the defibration causes partial dissociation of hydroxyl groups in hemicellulose or cellulose in the cellulose fibers, resulting in anionization of the molecules, which weakens intra- and intermolecular hydrogen bonds to promote dispersion of the cellulose fibers during the defibration.

As the alkali used in the alkali treatment, for example, sodium hydroxide, lithium hydroxide, potassium hydroxide, an aqueous ammonia solution, or organic alkali, such as tetramethylammonium hydroxide, tetraethylammonium hydroxide, tetrabutylammonium hydroxide, and benzyltrimethylammonium hydroxide may be used. In view of the manufacturing cost, sodium hydroxide is preferably used.

The enzyme treatment, acid treatment, or oxidation treatment prior to the defibration may result in a lower water retention, a higher degree of crystallinity, and also higher homogeneity of the fine fibers. In this regard, microfiber cellulose at a lower water retention is easily dewatered, so that dewaterability of a cellulose fiber slurry may be improved.

The enzyme treatment, acid treatment, or oxidation treatment of the cellulose fibers causes decomposition of the amorphous region of hemicellulose and cellulose in pulp, which leads to reduction of energy required for the defibration and to improvement in uniformity and dispersibility of the cellulose fibers. The pretreatment, however, lowers the aspect ratio of microfiber cellulose, and it is thus preferred to avoid excessive pretreatment for the purpose of using the microfiber cellulose as a reinforcing material for resins.

The bleaching may be peroxide bleaching, hypochlorite bleaching, chlorine dioxide bleaching, persulfate bleaching, oxone bleaching, or multistage bleaching of a combination of these, or reduction bleaching with hydrosulfite, sodium borohydride, or the like.

The defibration of the cellulose fibers may be performed by beating the raw material pulp in, for example, beaters, homogenizers, such as high-pressure homogenizers, counter collision-type homogenizers, and high-pressure homogenizing apparatus, millstone friction machines, such as grinders and mills, single-screw kneaders, multi-screw kneaders, kneaders, refiners, and jet mills. It is preferred to use refiners or jet mills.

The average fiber length (average of lengths of single fibers) of the microfiber cellulose is preferably 0.02 to 2.0 mm, more preferably 0.05 to 1.5 mm, particularly preferably 0.1 to 1.0 mm. With an average fiber length below 0.02 mm, the microfiber cellulose may not be able to form three dimensional networks among them, resulting in little improvement in the reinforcing effect on resins. With an average fiber length over 2.0 mm, the length of the microfiber cellulose differs nothing from that of the raw material pulp, so that the reinforcing effect may not be sufficient.

The average fiber length of the microfiber cellulose may arbitrarily be adjusted by, for example, selection, pretreatment, or defibration of the raw material pulp P1.

A proportion of the microfiber cellulose having a fiber length of 0.2 mm or shorter (fine fiber percentage) is preferably 20% or higher, more preferably 40% or higher, particularly preferably 60% or higher. With a ratio below 20%, sufficient resin reinforcing effect may not be achieved. On the other hand, there is no upper limit for the proportion of the microfiber cellulose having a fiber length of 0.2 mm or shorter, and all of the microfiber cellulose may have a fiber length of 0.2 mm or shorter.

The aspect ratio of the microfiber cellulose is preferably 2 to 15000, more preferably 10 to 10000. With an aspect ratio below 2, the microfiber cellulose may not be able to form three dimensional networks among them, resulting in poor reinforcing effect. On the other hand, with an aspect ratio over 15000, the microfiber cellulose tends to be highly entangled, which may lead to insufficient dispersion in the resin.

An aspect ratio is a value obtained by dividing the average fiber length by the average fiber width. A larger aspect ratio causes a larger number of locations to be caught, which enhances the reinforcing effect but, as such, is assumed to result in lower ductility of the resin.

The percentage of fibrillation of the microfiber cellulose is preferably 1.0 to 30.0%, more preferably 1.5 to 20.0%, particularly preferably 2.0 to 15.0%. With a percentage of fibrillation over 30.0%, the area of contact with water is too large, which may make the dewatering difficult even when the defibration results in the average fiber width within a range of 0.1 μm or larger. With a percentage of fibrillation below 1.0%, the hydrogen bonding between the fibrils may be too little to form firm three dimensional networks.

The average fiber length and the percentage of fibrillation of the fibers are measured using a fiber analyzer FS5 manufactured by Valmet K.K.

The degree of crystallinity of the microfiber cellulose is preferably 50% or higher, more preferably 55% or higher, particularly preferably 60% or higher. With a degree of crystallinity below 50%, the mixability with pulp or cellulose nanofibers may be improved, whereas the strength of the fibers per se may be lowered to make it difficult to enhance the strength of resins. On the other hand, the degree of crystallinity of the microfiber cellulose is preferably 95% or lower, more preferably 90% or lower, particularly preferably 85% or lower. With a degree of crystallinity over 95%, the ratio of firm hydrogen bonding within the molecules is high, which makes the fibers themselves rigid and impairs dispersibility.

The degree of crystallinity of the microfiber cellulose may arbitrarily be adjusted by, for example, selection, pretreatment, or making finer of the raw material pulp P1.

The degree of crystallinity is a value determined in accordance with JIS K 0131 (1996).

The pulp viscosity of the microfiber cellulose is preferably 2 cps or higher, more preferably 4 cps or higher. With a pulp viscosity of the microfiber cellulose below 2 cps, control of aggregation of the microfiber cellulose may be difficult.

The viscosity of the microfiber cellulose is a value determined in accordance with TAPPI T 230.

The freeness of the microfiber cellulose is preferably 500 ml or less, more preferably 300 ml or less, particularly preferably 100 ml or less. With a freeness of the microfiber cellulose over 500 ml, the average fiber diameter of the microfiber cellulose may exceed 10 μm, and sufficient effect to enhance resin strength may not be obtained.

The freeness is a value determined in accordance with JIS P8121-2 (2012).

The zeta potential of the microfiber cellulose is preferably −150 to 20 mV, more preferably −100 to 0 mV, particularly preferably −80 to −10 mV. With a zeta potential below −150 mV, compatibility with resins may significantly be deteriorated, resulting in insufficient reinforcing effect. With a zeta potential over 20 mV, dispersion stability may be impaired.

The water retention of the microfiber cellulose is preferably 80 to 400%, more preferably 90 to 350%, particularly preferably 100 to 300%. With a water retention below 80%, the microfiber cellulose differs nothing from the raw material pulp, so that the reinforcing effect may be insufficient. With a water retention over 400%, dewaterability tends to be poor, and the microfiber cellulose tends to aggregate. Note that the water retention of the microfiber cellulose may be made still lower by the substitution of its hydroxy groups with carbamate groups, which may improve dewaterability and drying property.

The water retention of the microfiber cellulose may arbitrarily be adjusted by, for example, selection, pretreatment, or defibration of the raw material pulp P1.

The water retention of the microfiber cellulose is a value determined in accordance with JAPAN TAPPI No. 26 (2000).

Next, cellulose nanofibers are discussed.

According to the present embodiment, cellulose nanofibers are fine fibers like microfiber cellulose, and have a peculiar role in improvement of resin strength.

Cellulose nanofibers may be obtained by defibrating (making finer) the reacted cellulose fibers P3. The raw material pulp P1 may be and is preferably the same as that for microfiber cellulose.

A raw material fibers of cellulose nanofibers may be pretreated or defibrated in the same way as for microfiber cellulose, provided that the degree of defibration is different. The defibration should be performed, for example, so that the average fiber diameter falls below 0.1 μm. In the following, cellulose nanofibers are discussed, focusing on the difference from microfiber cellulose.

The average fiber diameter (average fiber width or average of diameters of single fibers) of cellulose nanofibers is preferably 4 to 100 nm, more preferably 10 to 80 nm. With an average fiber diameter of the cellulose nanofibers below 4 nm, dewaterability may be impaired. Where the cellulose nanofibers are mixed with a dispersant, the dispersant may not sufficiently cover (cling to) the cellulose nanofibers, resulting in insufficient improvement in dispersibility of the cellulose nanofibers. With an average fiber diameter of the cellulose nanofibers over 100 nm, the fibers are no longer cellulose nanofibers.

The average fiber diameter of the cellulose nanofibers may be adjusted by, for example, selection, pretreatment, or defibration of the raw material pulp P1.

Methods of measurements of properties of the cellulose nanofibers may be the same as those for microfiber cellulose, unless otherwise specified herein.

The average fiber length (length of single fibers) of the cellulose nanofibers is preferably 0.1 to 1000 μm, more preferably 0.5 to 500 μm. With an average fiber length below 0.1 μm, the cellulose nanofibers may not be able to form three dimensional networks among them, resulting in poor reinforcing effect. With an average fiber length over 1000 μm, the cellulose nanofibers tend to be highly entangled, which may lead to insufficient dispersibility.

The average fiber length of the cellulose nanofibers may be adjusted by, for example, selection, pretreatment, or defibration of the raw material pulp P1.

The degree of crystallinity of the cellulose nanofibers is preferably 95 to 50%, more preferably 90 to 60%. With a degree of crystallinity of the cellulose nanofibers within this range, the strength of a resin may reliably be enhanced.

The degree of crystallinity may arbitrarily be adjusted by, for example, selection, pretreatment, or defibration of the raw material pulp P1.

The pulp viscosity of the cellulose nanofibers is preferably 1.0 cps or higher, more preferably 2.0 cps or higher. The pulp viscosity refers to a viscosity of a solution obtained by dissolving cellulose in a cupriethylenediamine solution, and a higher pulp viscosity indicates a higher degree of polymerization of cellulose. With a pulp viscosity of 1.0 cps or higher, the cellulose nanofibers may impart dewaterability to the slurry, and may be kept from decomposition in kneading with a resin to provide sufficient reinforcing effect.

The cellulose nanofibers obtained from the defibration may be kept in the form of a dispersion in an aqueous medium, as needed, prior to mixing with other cellulose fibers. The aqueous medium is particularly preferably water in its entirety (aqueous dispersion), but aqueous medium partly containing another liquid compatible with water may also be used. Such another liquid may be, for example, a lower alcohol having 3 or less carbon atoms.

The B-type viscosity of the dispersion of the cellulose nanofibers (1% concentration) is preferably 10 to 2000 cp, more preferably 30 to 1500 cp. With a B-type viscosity of the dispersion within this range, the cellulose nanofibers may easily be mixed with other cellulose fibers, and dewaterability of the cellulose fiber slurry may be improved.

The B-type viscosity of the dispersion (1% solid concentration) is a value as determined in accordance with JIS Z8803 (2011) "Methods for Viscosity Measurement of Liquid". B-type viscosity is resistant torque in stirring a dispersion, and a higher value indicates more energy required for stirring.

The carbamated fine fibers are dispersed in an aqueous medium to prepare a dispersion (slurry), as needed. The aqueous medium is particularly preferably water in its entirety, but aqueous medium partly containing another liquid compatible with water may also be used. Such another liquid may be, for example, a lower alcohol having 3 or less carbon atoms.

The solid concentration of the slurry is preferably 0.1 to 10.0 mass %, more preferably 0.5 to 5.0 mass %. With a solid concentration below 0.1 mass %, an excessive amount of energy may be required for dewatering and drying. With a solid concentration over 10.0 mass %, fluidity of the slurry per se may be too low to homogeneously admix with the dispersant, when used.

EXAMPLES

Next, Examples of the present invention will now be discussed.

A pulp sheet was prepared by adding a sizing agent to a pulp slurry, subjecting the resulting slurry to papermaking in the wire section so that a predetermined Cobb sizing degree was achieved, and then subjecting the resulting mass to the press section and the pre-dryer section, to thereby obtain a pulp sheet of a predetermined basis weight. Then, in the coater section, the pulp sheet was immersion-coated with a reaction agent (the meaning of the term "coating" is as discussed above, and it does not matter whether or not a coating layer is formed on the surface of the pulp sheet), and then dried in the after-dryer section, to obtain a pulp sheet impregnated with the reaction agent (cellulose fibers-containing material). The pulp sheet thus obtained was subjected to reaction in a reaction device as shown in Table 1 to obtain a pulp sheet in which the cellulose fibers had been modified (reacted cellulose fibers).

Next, the modified pulp sheet was diluted and disintegrated with water in a disintegrating machine to a 5% solid concentration. The aqueous dispersion of the modified cellulose fibers obtained from the disintegration was subjected to two cycles of dehydration and washing. The modified cellulose fibers thus washed was defibrated, taking into account the fine fiber percentage, to obtain modified fine fibers (microfiber cellulose). The results are shown in Table 1.

The reaction efficiency shown in the Table is calculated by the following formula:

$$\text{Reaction Efficiency} = A/B*100(\%)$$

A: amount of carbamate in mole (mol) introduced into cellulose measured after the reaction B: amount of urea in mol (mol) added before the reaction

TABLE 1

| | Reaction Method | Reaction Conditions | Reaction Time | Energy Consumption kWh/kg | Reaction Efficiency % |
|---|---|---|---|---|---|
| Test Example 1 | Heating Roll | 240° C. | 20 sec | 1.51 | 41.3 |
| Test Example 2 | Heating Roll | 240° C. | 30 sec | 2.37 | 52.0 |
| Test Example 3 | Microwave | 500 W | 60 sec | 11.57 | 21.5 |

TABLE 1-continued

| | Reaction Method | Reaction Conditions | Reaction Time | Energy Consumption kWh/kg | Reaction Efficiency % |
|---|---|---|---|---|---|
| Test Example 4 | Rotary Kiln | 160° C. | 3600 sec | 16.70 | 61.5 |
| Test Example 5 | Hot Air | 160° C. | 3600 sec | 2.00 | 16.0 |
| Test Example 6 | Far Infrared | 240° C. | 60 sec | 3.86 | 46.7 |

The results shows that the reaction method not only has impact on the energy consumption but also has great impact on the carbamation.

INDUSTRIAL APPLICABILITY

The present invention is applicable as a method for preparing carbamated cellulose fibers.

DESCRIPTION OF REFERENCE NUMERALS

100: papermaking step
110: wire section
120: press section
130: pre-dryer section
200: coating step
210: coater section
220: after-dryer section
P1: raw material pulp
P2: cellulose fiber-containing material
P3: carbamated cellulose fibers
P4: carbamated fine fibers
X1: papermaking/coating step
X2: carbamation step
X3: defibration step

The invention claimed is:

1. A method for preparing carbamated cellulose fibers in which hydroxy groups of cellulose fibers have partially or fully been modified with carbamate groups, the method comprising:

subjecting a raw material pulp to papermaking to form a pulp sheet in a strip shape, coating the pulp sheet with urea or a derivative thereof at a speed of 300 m/min or higher, followed by heating for drying to a moisture percentage of 10% or less, and then heating the dried pulp sheet for proceeding with the modification between a pair of rolls while passing therebetween.

2. The method according to claim 1, wherein the pulp sheet has a width of 300 to 10000 mm, and at least either one of the pair of the rolls is a heating roll.

3. The method according to claim 2, wherein the heating for drying is performed at 80 to 280 °C, and a heating temperature of the heating roll is 180 to 280 °C.

4. The method according to claim 1, wherein at least either one of the pair of the rolls is a heating roll, and a plurality of pairs of the rolls are provided in multiple stages, and wherein a heating temperature on a first stage is 80 to 140 °C, and heating temperatures on second and subsequent stages are within a range of 180 to 280 °C.

5. The method according to claim 1, wherein at least either one of the pair of the rolls is a heating roll, and a plurality of pairs of the rolls are provided in multiple stages, and wherein a linear nip pressure between a pair of the rolls on at least one of the stages is 1 to 100000 N/cm.

6. The method according to claim 1, wherein the step of subjecting the raw material pulp to paper-making to form a pulp sheet in a strip shape, the step of coating the pulp sheet with urea or a derivative thereof followed by heating for drying, and the step of modification with the urea or a derivative thereof, are incorporated in this order in the method as continuous on-machine steps.

* * * * *